US006474329B1

(12) United States Patent
Sears et al.

(10) Patent No.: US 6,474,329 B1
(45) Date of Patent: Nov. 5, 2002

(54) CELL PANEL FOR FURNACE

(75) Inventors: Merle Dana Sears, Mooresville; Stephen Leon Pulley, Carmel; Brian Alan Reeves, West Point, all of IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/981,455

(22) Filed: Oct. 17, 2001

(51) Int. Cl.[7] ..... F24H 3/02; F24H 3/00

(52) U.S. Cl. ..... 126/110 A; 126/110 R; 126/99 R; 126/114; 432/247

(58) Field of Search ..... 126/110 R, 99 R, 126/114, 119, 110 A, 106, 104 A, 116 R; 432/247; 248/205.1; 52/731.7; 165/122, 78; 417/423.1

(56) References Cited

U.S. PATENT DOCUMENTS 2,464,473 A * 3/1949 Wessel ..... 126/110 R
4,130,376 A * 12/1978 Dietsche ..... 126/110 R
5,042,453 A * 8/1991 Shellenberger ..... 126/110 R
5,060,722 A * 10/1991 Zdenek et al. ..... 126/110 R
5,094,224 A * 3/1992 Diesch ..... 126/110 R
5,370,106 A * 12/1994 Beck et al. ..... 126/110 R
6,126,436 A * 10/2000 Cabrera et al. ..... 126/110 R
6,227,191 B1 * 5/2001 Garloch ..... 126/110 R

* cited by examiner

*Primary Examiner*—Henry Bennett
*Assistant Examiner*—Kathryn Ferko
(74) *Attorney, Agent, or Firm*—Wall Marjama & Bilinski LLP

(57) ABSTRACT

A one piece cell panel for a forced air furnace which is designed for ease of removal without the necessity of having to dismantle the furnace cabinet. The panel includes a substantially vertically disposed upper section which contains a plurality of cell inlets and cell outlets and an integral lower horizontal shelf which is disposed at a predetermined acute angle downward below the horizontal. The cell panel has a substantially rectangular front profile and an "L" shaped side profile.

3 Claims, 4 Drawing Sheets

CELL PANEL FOR FURNACE

BACKGROUND OF THE INVENTION

The present invention is directed to a furnace that provides heated circulation air to an interior comfort space such as a home or a commercial building. The invention is concerned with a cell panel design which provides for ease of removal of the cell panel and heat exchanger cells without the necessity of having to dismantle the furnace cabinet.

In a forced air furnace, the circulation air blower is supported on a horizontal blower shelf beneath the heat exchanger cell. Most current furnace designs provide a blower shelf that fits from the back of the casing all the way to the front of the furnace. With this design the result is either a tight fitting difficult to assemble part or a loose fitting part. A loose fitting joint formed by the blower shelf and cell panel can create an air leak under the burner assembly disrupting combustion. This typical prior art structure is illustrated more clearly in FIGS. 1 and 2 of U.S. Pat. No. 5,392,761 which is incorporated herein by reference.

A further disadvantage of this prior art structure is that it prevents removal of the cell panel and heat exchanger without removing the flange of the top plate. The current prior art design also prevents the blower from being inserted directly into position without rotating the blower, which causes difficulties for service personnel.

It can therefore be seen that there is a need for a cell panel design which addresses and overcomes the problems of the prior art described above.

SUMMARY OF THE INVENTION

It is therefore an object of the present invention to provide for a cell panel design which facilitates easy assembly and disassembly.

It is a further object of the present invention to provide for a cell panel which facilitates the installation and removal of the blower assembly.

It is a further object of the present invention to provide for a cell panel design which eliminates air leaks under the burner assembly.

It is yet another object of the present invention to provide for a unitized high strength panel design which contains a shelf extension.

The present invention is directed to a cell panel for a furnace which provides for ease of removal of the cell panel and cells without the necessity of having to dismantle the furnace cabinet. The design is a single piece cell panel and front blower shelf in the shape of an "L" with the "L" bend adding strength to the cell panel.

The panel has a sloping shelf allowing the cell panel and heat exchangers to move down toward the center of the furnace avoiding the flange of the top plate. This feature allows the heat exchanger bundle to be removed from the furnace without having to remove any parts of the casing and few internal parts. The cell panel further contains a shortened blower shelf which makes it easier to install in the furnace cabinet. The design further contains an "L" offset of the blower shelf which allows the blower rails to extend below the height of the shelf created by the cell panel extension. This design allows the blower assembly to be inserted straight into the furnace cabinet without any rotation, which is an ergonomic benefit to the assembler since the blower assembly does not have to be rotated into place. Another advantage of the cell panel shelf extension is that the typical joint formed by the blower shelf and cell panel can create an air leak under the burner assembly disrupting combustion. The present design also eliminates the joint under the burner. In addition, the sharply bent shelf extension adds significant strength to the cell panel

BRIEF DESCRIPTION OF THE DRAWINGS

For a further understanding of these and objects of the invention, reference will be made to the following detailed description of the invention which is to be read in connection with the accompanying drawings, wherein.

DETAILED DESCRIPTION OF THE INVENTION

Figure 1:
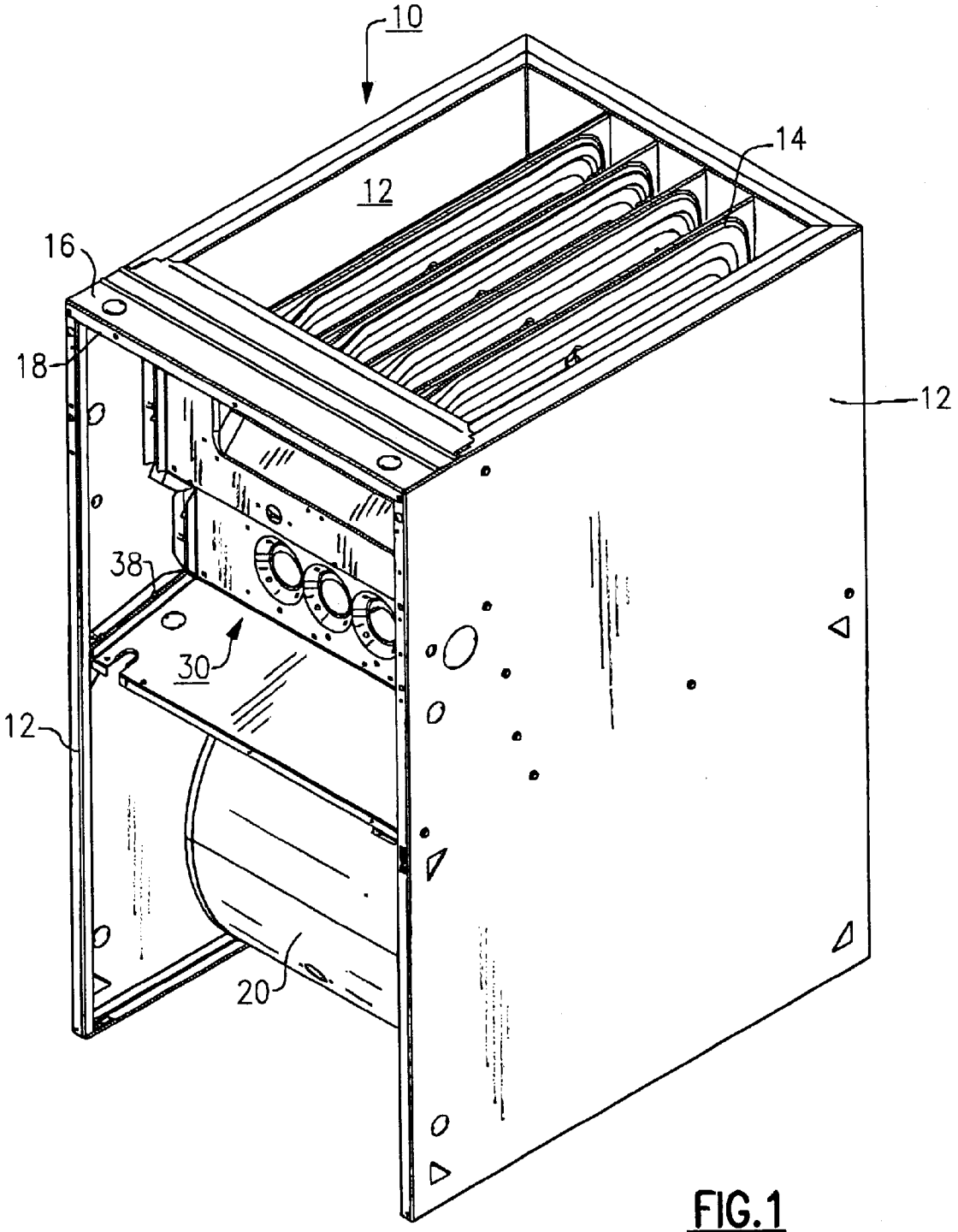
FIG. 1 is a perspective view of a furnace with the cell panel of the present invention in place with the front and top cabinet panels removed.

Referring to FIG. 1 of the drawings there is illustrated a perspective view of a forced air furnace which depicts the cell panel design of the present invention. This view illustrates only the key components necessary to illustrate the present invention and the relationship of other key furnace components as they relate to the novel panel described herein. Furnace 10 contains an outer cabinet formed by a plurality of outer panels 12 and an heat exchanger 14. A top plate 16 containing a downward flange 18 provides support for the furnace cabinet. A bottom plate (not shown) similar to top plate 16 normally connects or joins side panels 12 together at their bottom front corners. A blower assembly 20 is located beneath the heat exchanger and cell panel 30 of the present invention is positioned above the blower assembly. The cell design panel of the present invention may be suitable for use with any conventional type forced air furnace as illustrated broadly in FIG. 1. The basic components and operation of such a furnace are shown in greater detail in U.S. Pat. Nos. 5,647,742 and 5,392,761 which are incorporated herein by reference.

Figure 2:
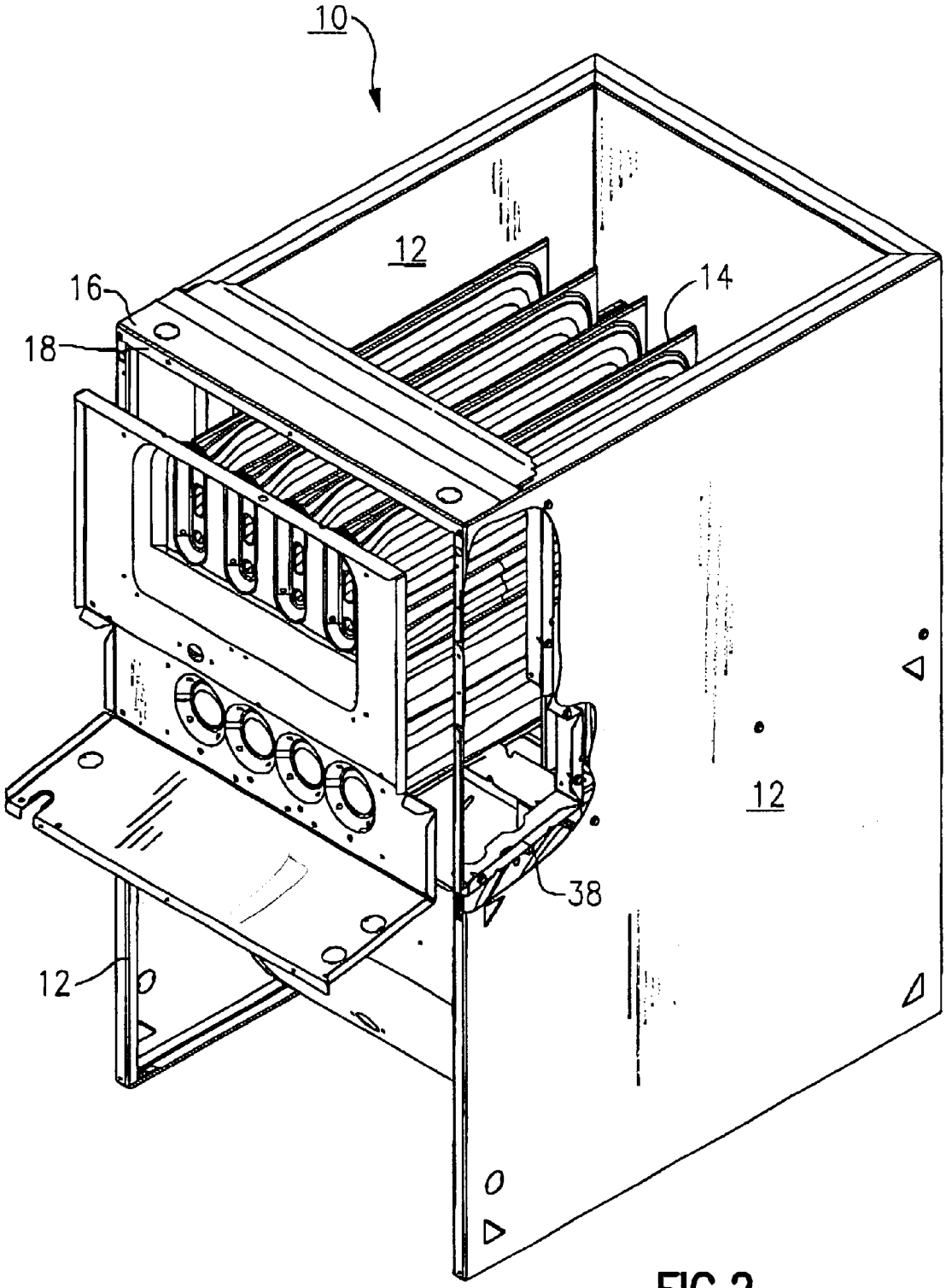
FIG. 2 is the perspective view of FIG. 1 with cell panel partially removed.
Figure 4:
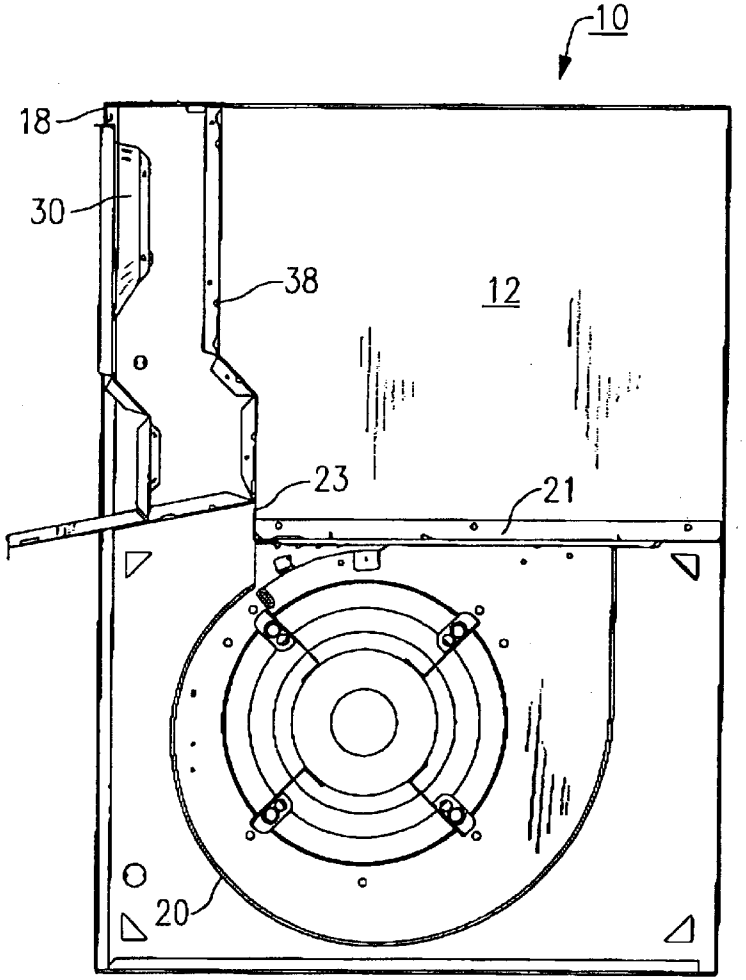
FIG. 4 is the view of FIG. 3 with the blower in its assembled position, with the cell panel partially removed.
Figure 3:
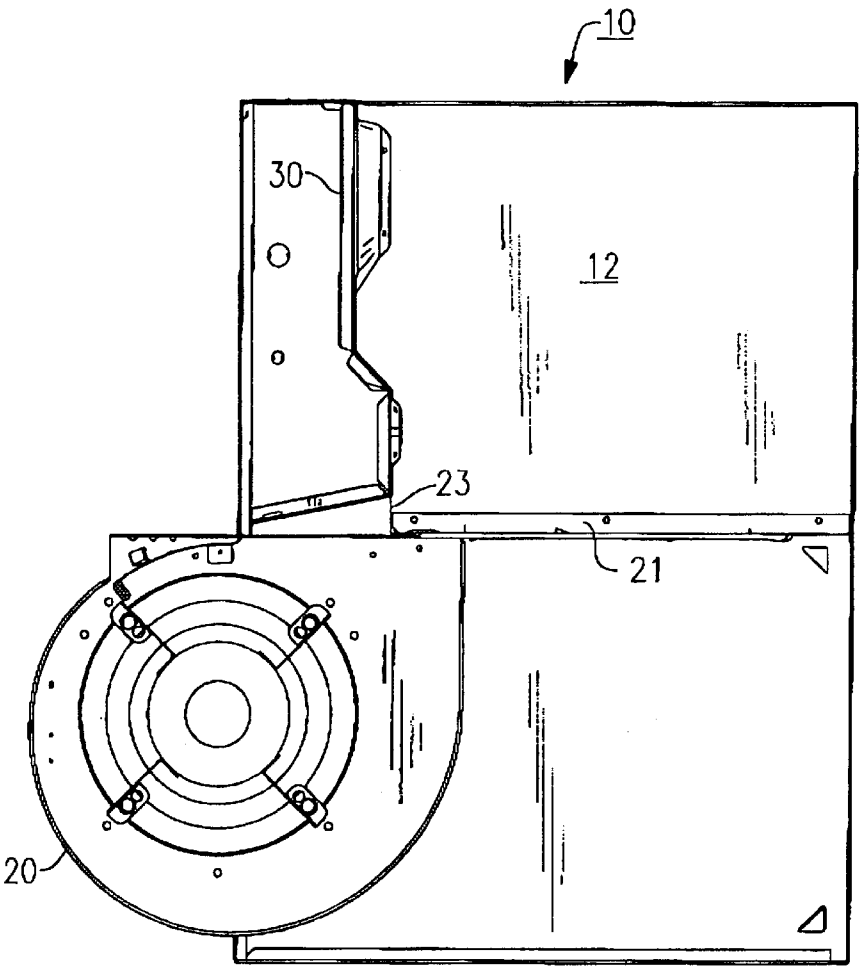
FIG. 3 is partial side sectional view of the furnace of FIG. 1 with the blower partially removed.
Figure 5:
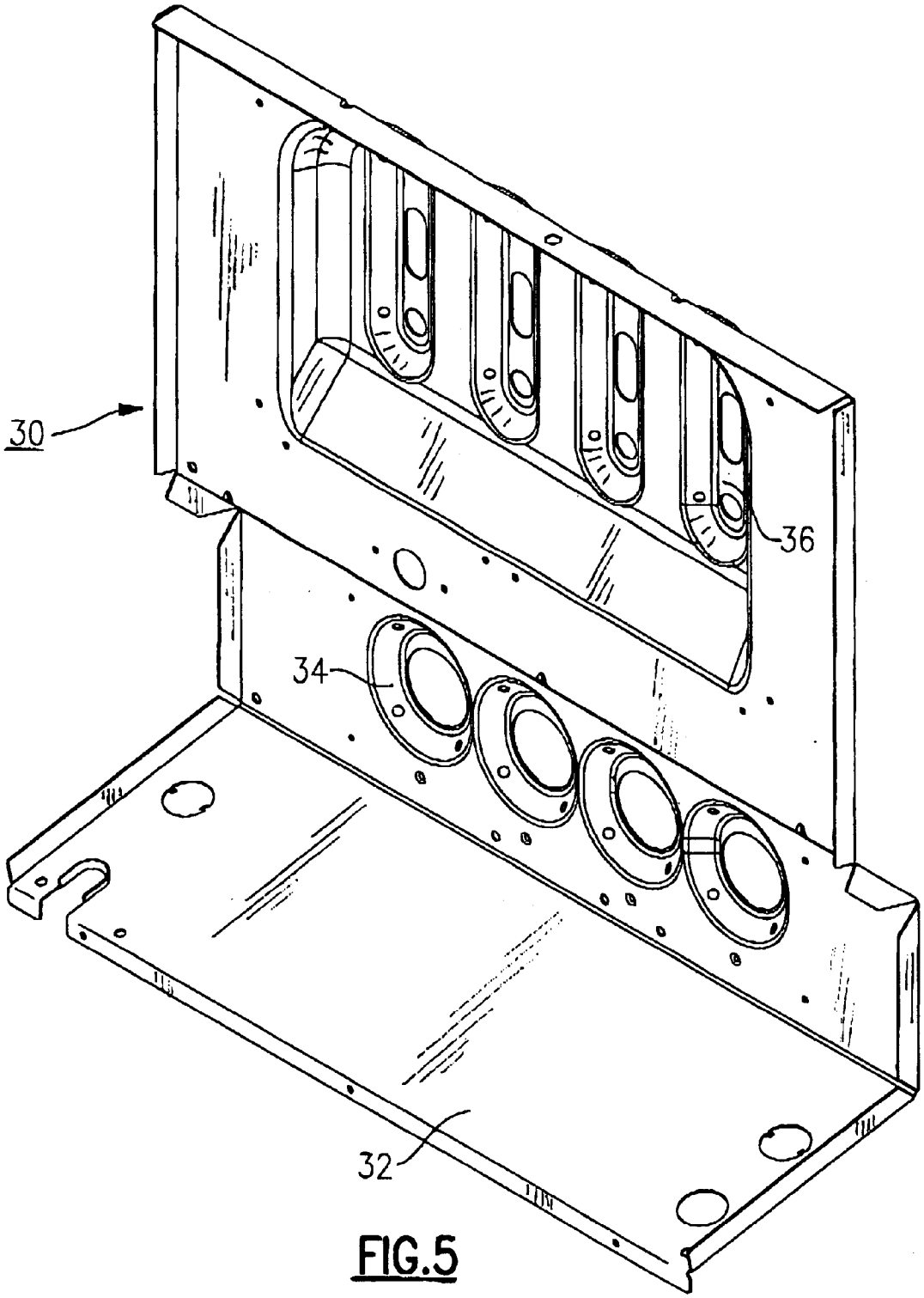
FIG. 5 is a perspective view of the cell panel of the present invention.

The panel structure itself is shown in detail in FIG. 5 and basically comprises a unitized single piece structure made in the form of an "L" and having a lower sloping shelf 32, a plurality of cell inlets 34 and cell outlets 36 that are substantially vertical in relationship to the sloping lower shelf. The sloping angle of the shelf constitutes a predetermined acute angle from the horizontal which is designed to be accommodated in cell panel supports 38 which are contained on opposites sides on the inside of the side cabinet walls. The sloping shelf in conjunction with the accommodating angle of the cell panel supports allows the panel to be removed and clear the flange 18 of the top plate without the necessity of removing the top plate in that when the cell panel is pulled out from its assembled position, the panel and associated heat exchanger move down to the center of the furnace allowing the panel to clear the flange 18 of top plate 16. This design feature allows the heat exchanger bundle to be removed from the furnace, as shown in FIGS. 2 and 4, without having to remove any parts of the casing and few internal parts. FIGS. 3 and 4 are partial side sectional views which show the relationship between the cell panel and blower assembly without the heat exchanger being shown. In FIG. 3, the blower has been partially removed with the cell panel in place in cell panel supports 38. In FIG. 4 the cell panel 30 has been partially removed with the blower shown in its assembled position. It can be seen that the design of the present invention allows for a shortened blower shelf 21, and also allows the blower shelf to extend below the height of the shelf extension 32 of cell panel 30, which facilitates the removal of the blower out of the furnace without any required rotation, which is a significant ergonomic advantage to an assembler, since the heavy weight if the blower assembly does not have to be rotated during assembly or disassembly. The shelf panel extension further provides for the advantage that the typical joint formed by the blower shelf and the cell panel in typical prior art construction has been eliminated. Note that flange extension 23 on the blower shelf functions to form an effective seal between the blower shelf and cell panel. Furthermore, the construction of cell panel and extension shelf adds significant strength to the cell panel in addition to providing for the advantages enumerated above.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A forced air furnace which includes an outer cabinet of a generally rectangular-shape having a rear panel and two connecting side panels which define an internal chamber, said cabinet containing a one piece cell panel and associated heat exchanger panels and a blower assembly, with said cell panel comprising a vertical upper section which includes a plurality of cell outlets and cell inlets and an integral lower horizontal shelf which is sloped downwardly from the horizontal plane and outwardly from said furnace chamber, with said cell panel forming the front top section of one furnace panel; a blower assembly positioned below and rearward of said cell panel, and supported from above by a blower shelf which traverses from the back of said furnace cabinet to the beginning of the back of the horizontal sloping shelf of said cell panel to form a seal therebetween, with the angle of said sloping cell panel shelf being such that the blower assembly can be directly horizontally removed from said furnace cabinet by passing below said cell panel without dismantling or removing said cell panel.

2. The furnace of claim 1 in which the cell panel vertical upper section and lower horizontal sloping shelf form an "L" shape in side view, with the inside surface of said side panels of said cabinet containing support means for said cell panel which mate with the said cell panel when the cell panel is in the assembled position.

3. A one piece cell panel for a forced air furnace which is designed for ease of removal without the necessity of having to dismantle a furnace cabinet, said cell panel comprising a substantially vertically disposed upper section which contains a plurality of cell inlets and cell outlets and an integral lower horizontal shelf which is disposed at a predetermined acute angle downward below the horizontal, with said cell panel having a substantially rectangular front profile and an "L" shaped side profile.

* * * * *